United States Patent [19]

Bartley

[11] Patent Number: 4,921,173

[45] Date of Patent: May 1, 1990

[54] METHODS OF MINERAL BREAKING AND APPARATUS USED THEREFOR

[76] Inventor: Bryan A. Bartley, 625 Mount Eden Road, Mount Eden, Auckland, New Zealand

[21] Appl. No.: 355,137

[22] Filed: May 16, 1989

Related U.S. Application Data

[63] Continuation of Ser. No. 135,574, Dec. 21, 1987, abandoned, which is a continuation of Ser. No. 905,629, Sep. 9, 1986, abandoned.

[30] Foreign Application Priority Data

Sep. 17, 1985 [NZ] New Zealand ..... 213510

[51] Int. Cl.[5] ..... B02C 19/00

[52] U.S. Cl. ..... 241/5; 241/24; 241/79.1; 241/275

[58] Field of Search ..... 241/79, 79.1, 5, 275, 241/80, 97, 24

[56] References Cited

U.S. PATENT DOCUMENTS

| | | | |
|---|---|---|---|
| 1,293,655 | 2/1919 | Adams | 241/275 X |
| 2,906,465 | 9/1959 | Sweet . | |
| 3,180,582 | 4/1965 | Danyluke | 241/275 |
| 3,567,141 | 3/1971 | Zbraniborski et al. | 241/275 X |
| 3,782,643 | 1/1974 | Carpenter . | |
| 3,881,664 | 5/1975 | Bowling, Jr. et al. | 241/275 |
| 4,436,138 | 3/1984 | Kondo | 241/275 X |
| 4,575,013 | 3/1986 | Bartley | 241/275 |

FOREIGN PATENT DOCUMENTS

| | | |
|---|---|---|
| 0140613 | 5/1985 | European Pat. Off. . |
| 376760 | 7/1932 | United Kingdom . |

*Primary Examiner*—Mark Rosenbaum
*Attorney, Agent, or Firm*—Ladas & Parry

[57] ABSTRACT

A method of and apparatus for breaking stone rock or other frangible material and separating fines from the resultant mixture, having a cyclonic breaking zone in a lower part of a housing in which a rotor operates to break up larger pieces, the action causing fines to rise in the housing for discharging from an upper region of the housing. Alternative positions for exits for the fines are in the wall or roof of the housing or in a shelf which extends outwardly beyond the wall confining the breaking zone.

9 Claims, 4 Drawing Sheets

Figure 1:
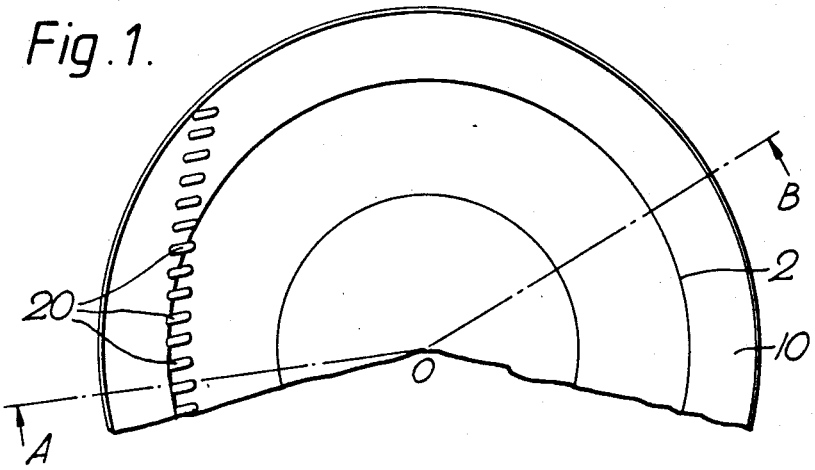

Fig. 4.
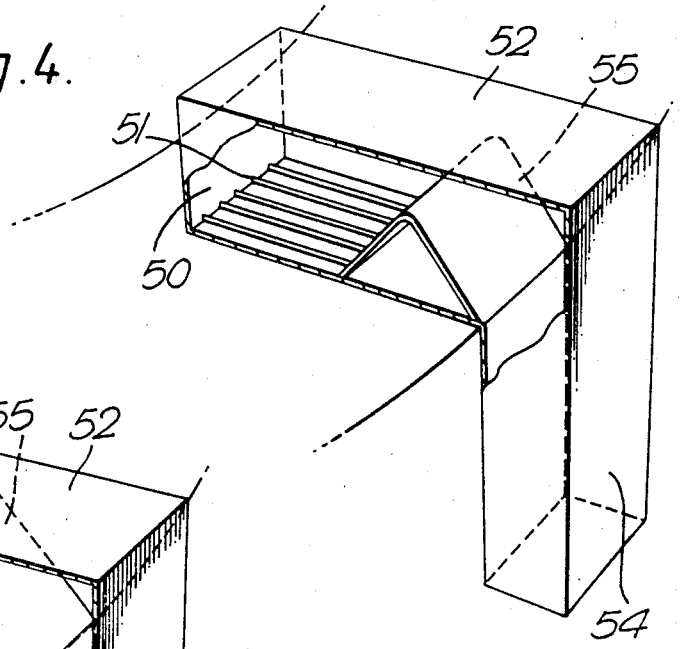
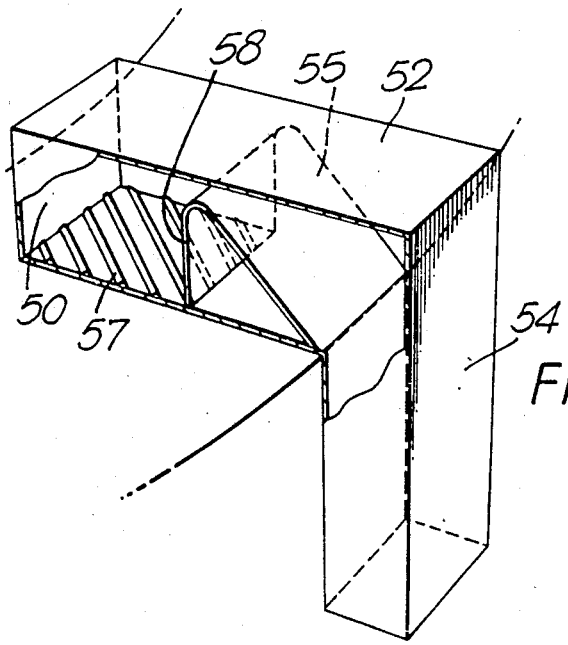
Fig. 5.
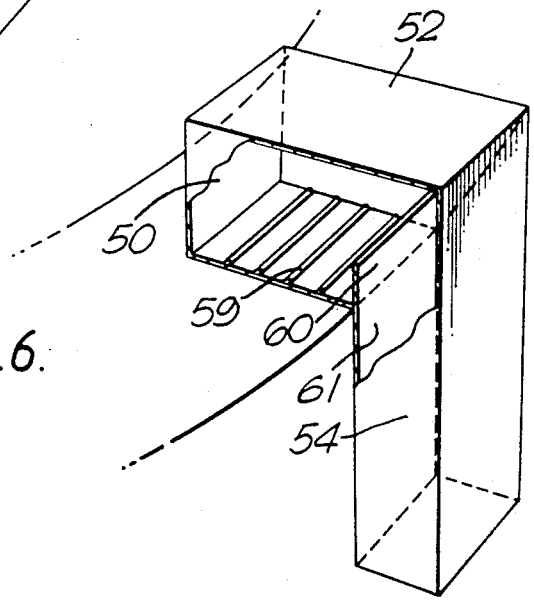
Fig. 6.

METHODS OF MINERAL BREAKING AND APPARATUS USED THEREFOR

This is a continuation of application Ser. No. 07/135,574 filed Dec. 21, 1987, now abandoned, which was a continuation of application Ser. No. 07/905,629, filed Sept. 9, 1986, now abandoned.

This invention relates to methods of mineral breaking and/or apparatus used therefor.

Rotary impact rock-on-rock crushers have proved to be very satisfactory commercially following the development of the basic rotary impact rock-on-rock disintegrator which is described and claimed in our U.S. Pat. No. 3,970,257. One of the characteristics of our rotary impact rock-on-rock crusher is that the efficiency of the abrading environment within the breaking zone is such that a significant percentage of fine grade particles (herein called fines) is produced and this, for some applications, if judged to be undesirable. We have also found that such rotary impact disintegrators are useful with feedstocks other than rock or stone, for example coal.

It is therefore an object of the present invention to provide a method of breaking feedstock and apparatus used therefor to allow for the separation of a stream of fines during operation and which will provide the public with a useful choice.

Accordingly in one aspect the invention consists in a method of obtaining a mixture of coarse particles and fines by breaking or shattering a feedstock of stones or rocks or other fragile material and separating a stream of fines from the mixture, said method comprising the steps of accelerating a stream of said feedstock into a cyclonic breaking zone in a housing where the feedstock is subjected to multi collisions and abrading forces, the action within the breaking zone causing at least some of said fines to rise towards an upper region of said housing and causing at least some of said fines to be discharged from said upper region of said housing.

In a further aspect the invention consists in a method of obtaining a mixture of coarse broken particles and fines, from a feedstock of larger stones, rocks or other fragible material and of separating a stream of at least some of said fines from a resultant mixture of broken pieces, said method comprising the steps of accelerating a stream of said larger particle feedstock into a cyclonic breaking zone in a lower part of a housing where the feedstock is subjected to multi collisions and abrading forces with the action within the breaking zone causing fines to rise towards an upper region of said housing allowing at least some upwardly directed fines to collect on a collecting shelf extending outwardly from an upper part of said breaking zone to collect said upwardly directed fines and removing at least some of said upwardly directed fines from the collecting shelf and adjacent thereto for disposal.

In a still further aspect the invention consists in apparatus for breaking and shattering a feedstock of larger rock stone or other frangible material breaking into coarse broken particles and fines, and separating a stream of at least some fines from a resultant mixture of broken pieces said apparatus comprising a housing, a feedstock accelerating horizontally disposed rotor rotatably supported in said housing and designed to accelerate feedstock to be discharged from the periphery of the rotor into a breaking zone in a lower part of said housing and surrounding the rotor with a cyclonic action and movement of accelerated feedstock generated by the rotor within the chamber producing a breaking and abrading environment, a shelf means provided in the housing extending outwardly from adjacent the top of the breaking zone to provide a collection surface on which fines collect, and ports in the shelf through which collected fines are moved to disposal.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

Figure 2:
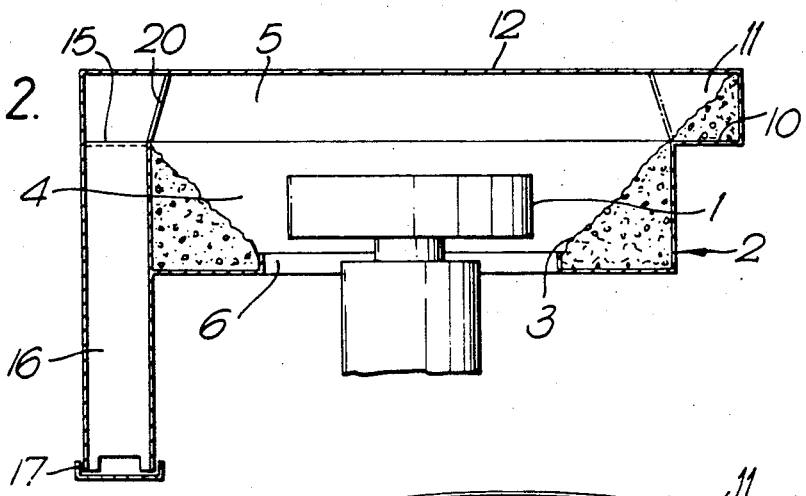
Figure 3:
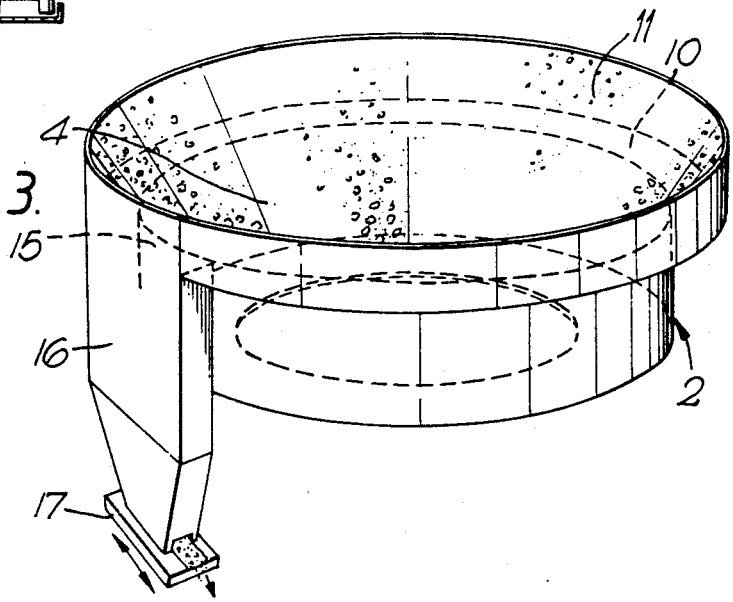
Figure 7:
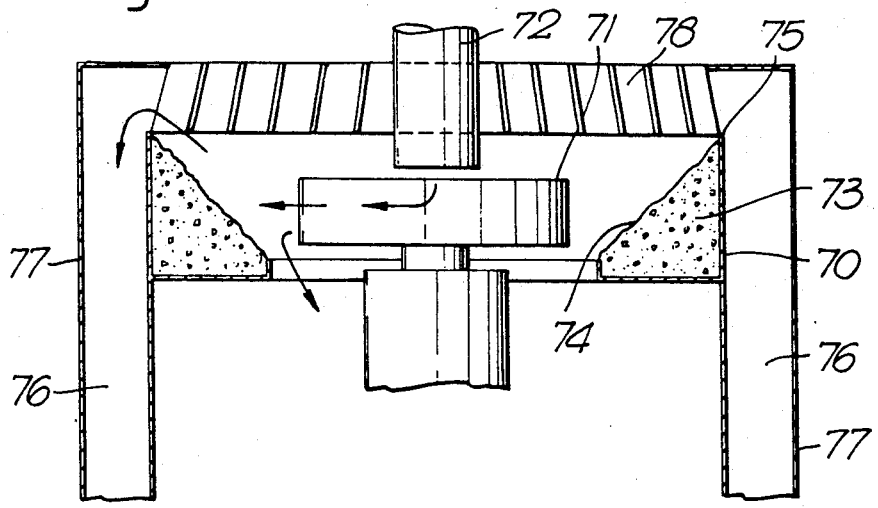
Figure 8:
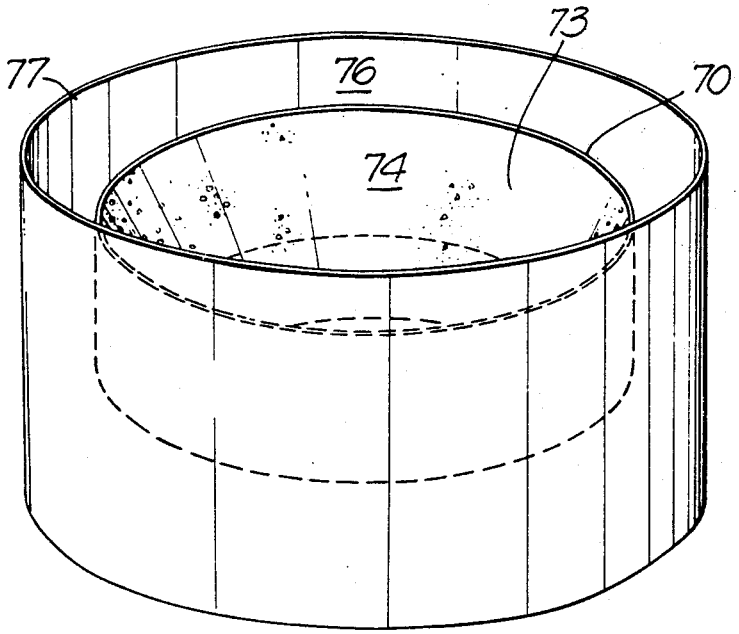
Figure 9:
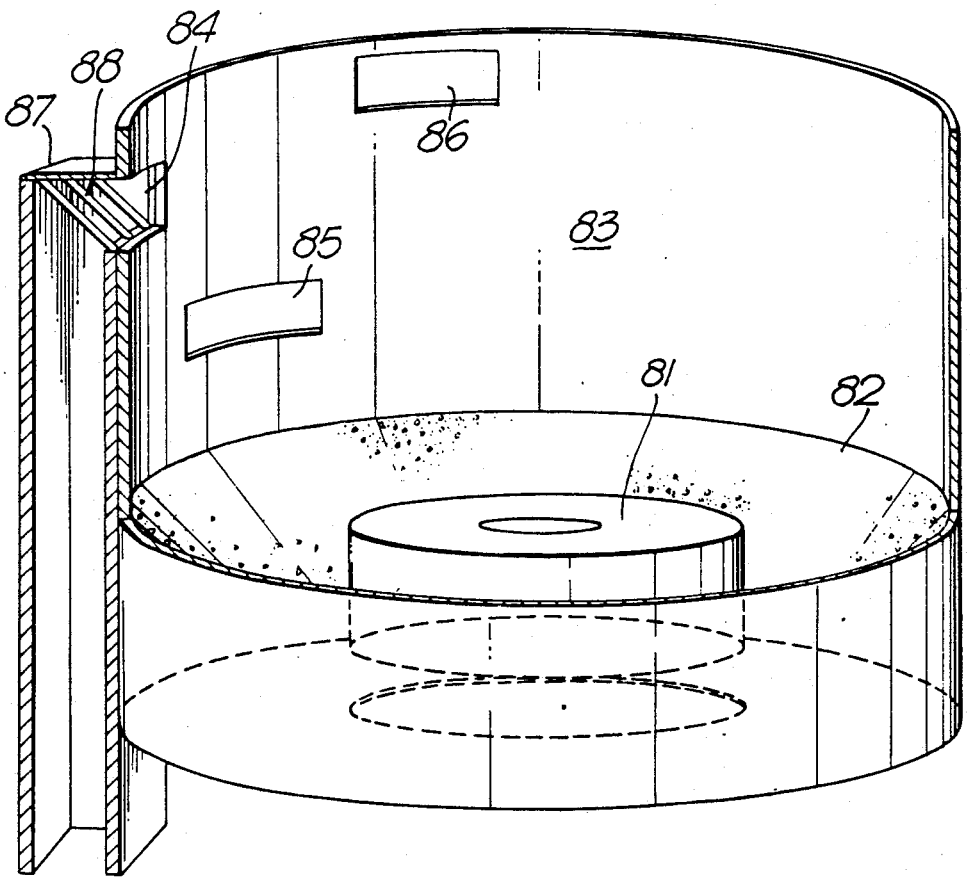

FIG. 1 is a diagrammatic plan view of mineral breaking apparatus according to the invention, FIG. 2 is a cross section on the line AOB, FIG. 1, FIG. 3 is a diagrammatic perspective sketch of the apparatus of FIGS. 1 and 2 with the top (roof) and rotor not shown, FIGS. 4 to 6 are perspective sketches of alternative delivery ports and chutes, in the top surface over the breaking zone, FIGS. 7 and 8 are a cross section and perspective sketch respectively of a further alternative form of apparatus, and FIG. 9 is a diagrammatic sketch of an alternative form of construction.

Referring to the drawings in the preferred form of the invention breaking apparatus for feedstock selected from rock, stone and other frangible materials for example coal is constructed and preferably comprises apparatus having a general configuration similar to that described and claimed in New Zealand Patent Specification No. 168612. The apparatus is generally used for breaking small rocks or large stones into road and building aggregates including fines usually classed in the trade as sands. In such a construction a horizontally mounted mineral particle accelerating rotor discharges a stream of mineral particles into a housing and the outer wall of the housing has a bed of retained mineral material formed thereagainst normally at its natural angle of response.

Various modifications of this basic configuration can be adopted allowing for a split feed (not shown) or allowing for a separate feed of mineral particles (not shown) into the breaking zone 4 surrounding the rotor.

The action of the rotor 1 within the housing 2 which has a top or roof 12 creates a cyclonic air action in the breaking zone 4 with accelerated mineral particles being rotated around the zone and further a bed of retained mineral material having a surface normally at the natural angle of repose, particles being accelerated into the swirling mass, this environment creates a multiplicity of collisions between mineral particles with both breaking and abrading forces reducing the size of the mineral particles. As a consequence of this action the small particles tend to concentrate towards the upper region 5 of the housing 2 and the heavier particles tend to move towards the lower part 6 of the zone for delivery therefrom.

The upper region 5 of the housing 2 extends outwardly as a substantially horizontal shelf 10. This shelf is confined within the housing and provides a collection chamber 11 where fines may move out of the hostile cyclonic environment and settle on the shelf but still with sufficient turbulence to cause the material to be moved around the shelf so that by providing a desired number of outlet parts e.g. two diametrical opposed ports 15 in the shelf, the material will be moved around to fall through these ports. A chute 16 from each port is designed to cause the fine material to be delivered to a discharge point where a stream of the fine material can be separated from the machine, and classified e.g. by the use of sieves.

A fence or screen of for example projecting fingers 20 with the fingers projecting vertically as shown or horizontally or at an angle may be an additional desirable feature to minimise any stray larger mineral particle from being thrown on to the shelf. Any such screen is designed so that larger particles will not accumulate thereon but will fall from the screen preferably under the influence of gravity and for example the fingers 20 form a slightly inwardly upwardly directed fence incorporated at or adjacent the junction between the shelf and the wall of the housing adjacent the base of the retained material collected.

A convenient means of disposing of the fine material is to provide a reciprocating plate discharging device 17 at the bottom of each chute 16 so that the fine material is accumulated on the reciprocating plate thereof and as the plate slides forward fine material drops in behind and with the plate being again retracted, some of the fine material is pushed off the end to be discharged for disposal into a hopper, conveyer or other convenient means. This method of disposal of the fine means that there is always a plug of material in the chute 16 and consequently any air flow passing out through this part of the machine is substantially reduced. Alternatively the discharge may be on to a conveyor with or without the need for an air flow block.

In FIGS. 4 to 6 varying forms of discharge ports in the roof or top 12 over the breaking zone and chutes are shown. Thus in FIG. 4 transverse bars are positioned within port 50 with a horizontal chute 52 above the port 51 leading to a vertical downwardly directed chute 54. A deflector or bed of aggregate 55 assists in causing only fines to pass into chute 54 and in preventing larger pieces of aggregate from passing.

In FIG. 5 the port 50 has diagonal bars 57 and the deflector 55 has a substantially vertical face 58.

In FIG. 6 the bars 59 are arranged in the port 50 in the direction of flow and the deflector 60 is simply an extension of the inner wall 61 of the chute 54. Of course different combinations of these variables could be used. In each figure the front walls of the chutes have been omitted for clarity.

In FIGS. 7 and 8 an alternative embodiment of the invention is shown having a housing 70, a rotor 71, an infeeding chute 72 and a bed of aggregate 73 having a surface 74 at the natural angle of repose for the operating conditions. The fines pass upwardly and over the top edge 75 of the housing to pass into a space 76 between an outer casing 77 and the outer surface of the housing 70. The edge 75 need not be continuous but openings only could be provided and the space 76 then having divisions, to provide a series of tubes. Sloping walls or a helix may be provided to direct the downwardly passing fines. A cage of bars 78 blocks the passage of larger pieces of aggregate.

Referring now to FIG. 9, a rotor 81 is disposed within a breaking zone 82 as with the above described construction and an outer wall 83 is continued as a hollow cylinder above the breaking zone 82. In the outer wall 83 are one or more exits of which 3, referenced 84, 85 and 86 are shown. These are disposed at different levels and each is preferably connected to a discharge chute such as the chute 87 which may or may not have bars similar to the bars 78, 51, 57 or 59 and deflectors similar to deflectors 55 or 60 appropriately positioned e.g. as shown at 88 and 89 in FIG. 9. With this arrangement, different grades of fines will exit at the various levels because of the differing centrifugal effects due to the different particle weights of the fines.

It will be seen that by the foregoing constructions the stream of fines is taken from the mineral breaking apparatus and the fines may be separately used or may be blended back into the remaining aggregate delivered from the breaking zone as is described more fully in our U.S. Pat. No. 3,970,257.

The invention at least in the prefered form provides a ready method of extracting fines from a mixture of coarse aggregate and fines in a simple yet effective way and thus reduces the handling necessary in producing a graded aggregate.

What is claimed is:

1. A method of obtaining a mixture of coarse broken particles and fines from a feedstock of larger stones, rocks or other frangible material and of separating a stream of at least some of said fines from a resultant mixture of broken pieces, said method comprising the steps of accelerating a stream of said larger particle feedstock into a cyclonic breaking zone in a lower part of a housing where the feedstock is subjected to cyclonic action including multiple collisions and abrading forces, with the action within the breaking zone causing fines to be moved directly upwardly from the breaking zone towards an upper region of the said housing and causing at least some of said upwardly directed fines to be moved outwardly by said cyclonic action for disposal through exits disposed in upper parts of said housing, all of said fines reaching said exits arriving directly from said breaking zone.

2. A method as claimed in claim 1 wherein said housing has an upper hollow cylindrical part and said fines are discharged through a series of exits arranged at different levels in said wall for collecting different grades of fines from each of said exits.

3. A method as claimed in claim 1 which includes the steps of inhibiting the egress of larger broken pieces with said upwardly directed fines.

4. Apparatus for breaking and shattering a feedstock of larger rocks, stones or other frangible material and breaking and separating a stream of at least some fines from a resultant mixture of broken pieces, said apparatus comprising a housing, a feedstock accelerating, horizontally disposed rotor rotatably supported in a lower part of said housing and designed to accelerate feedstock to be discharged from the periphery of the rotor into a breaking zone in a lower part of said housing and surrounding the rotor with a cyclonic action, and movement of accelerated feedstock from the rotor into the breaking zone producing a breaking and abrading environment, and exit means in an upper part of said housing, said cyclonic action causing at least some fines to be moved directly upwardly from said breaking zone into and outwardly of said upper part for disposal through said exit means, said upper part of said housing comprising a hollow cylinder, and a series of exits being provided at different levels in the wall of said cylinder for the collection of different grades of fines from each of said exits.

5. Apparatus for breaking and shattering a feedstock of larger rocks, stones or other frangible material and breaking and separating a stream of at least some fines from a resultant mixture of broken pieces, said apparatus comprising a housing, a feedstock accelerating, horizontally disposed rotor rotatably supported in a lower part of said housing and designed to accelerate feedstock to be discharged from the periphery of the rotor into a breaking zone in a lower part of said housing and surrounding the rotor with a cyclonic action, and movement of accelerated feedstock from the rotor into the breaking zone producing a breaking and abrading environment, and exit means in an upper part of said housing, said cyclonic action causing at least some fines to be moved directly upwardly from said breaking zone into and outwardly of said upper part for disposal through said exit means, and screening means being included upstream of said discharge means to obviate or minimize larger pieces of broken feedstock being moved to disposal.

6. Apparatus for breaking and shattering a feedstock of larger rocks, stones of other frangible material and breaking and separating a stream of at least some fines from a resultant mixture of broken pieces, said apparatus comprising a housing, a feedstock accelerating, horizontally disposed rotor rotatably supported in a lower part of said housing and designed to accelerate feedstock to be discharged from the periphery of the rotor into a breaking zone in a lower part of said housing and surrounding the rotor with a cyclonic action, and movement of accelerated feedstock from the rotor into the breaking zone producing a breaking and abrading environment, and exit means in an upper part of said housing, said cyclonic action causing at least some fines to be moved directly upwardly from said breaking zone into and outwardly of said upper part for disposal through said exit means, said housing supporting a bed of broken feedstock material at its natural angle of repose against the outer wall thereof, and said exit means comprising a shelf for collecting the fines, said shelf extending outwardly from adjacent the top of the bed of material.

7. Apparatus as claimed in claim 6 wherein two or more diametrically opposed ports are provided in the shelf through which the desired fines move into a disposal chute or chutes.

8. Apparatus as claimed in claim 7 wherein a reciprocating plate is provided at a lower end of each of said chute or chutes and the delivered fines moving into said chute land on said reciprocating plate which is operated to discharge a series of quantities of fines without allowing any significant passage for air flow.

9. Apparatus for breaking and shattering a feedstock of larger rocks, stones or other frangible material and breaking and separating a stream of at least some fines from a resultant mixture of broken pieces, said apparatus comprising a housing, a feedstock accelerating, horizontally disposed rotor rotatably supported in a lower part of said housing and designed to accelerate feedstock to be discharged from the periphery of the rotor into a breaking zone in a lower part of said housing and surrounding the rotor with a cyclonic action, and movement of accelerated feedstock from the rotor into the breaking zone producing a breaking and abrading environment, and exit means in an upper part of said housing, said cyclonic action causing at least some fines to be moved directly upwardly from said breaking zone into and outwardly of said upper part for disposal through said exit means, deflection means being provided downstream of said exit means to assist in deflecting larger pieces of material from delivery through the exit means.

* * * * *